US007093331B1

(12) United States Patent
Holmberg et al.

(10) Patent No.: US 7,093,331 B1
(45) Date of Patent: Aug. 22, 2006

(54) BUCKLE AND FRAME FOR RESTRAINT SYSTEM RESISTANT TO A HARSH ENVIRONMENT

(75) Inventors: Erin Edward Holmberg, Gilbert, AZ (US); Michael James Walton, Phoenix, AZ (US); Timothy Andrew Swann, Mesa, AZ (US); Agus Suryana The, Mesa, AZ (US); Jeffrey Philip Baldwin, Phoenix, AZ (US)

(73) Assignee: AmSafe Commercial Products, Inc., Elkhart, IN (US)

( * ) Notice: Subject to any disclaimer, the term of this patent is extended or adjusted under 35 U.S.C. 154(b) by 0 days.

(21) Appl. No.: 10/794,554

(22) Filed: Mar. 5, 2004

(51) Int. Cl.
*A44B 11/25* (2006.01)

(52) U.S. Cl. ..... 24/633; 24/634

(58) Field of Classification Search ..... 24/633, 24/634
See application file for complete search history.

(56) References Cited

U.S. PATENT DOCUMENTS 3,331,108 A 7/1967 Fisher et al.
3,921,262 A 11/1975 Tanaka
4,550,474 A * 11/1985 Doty et al. ..... 24/633
4,637,102 A 1/1987 Teder et al.
4,731,912 A * 3/1988 Boriskie et al. ..... 24/633
4,876,772 A 10/1989 Anthony et al.
4,942,649 A 7/1990 Anthony et al.
4,987,662 A * 1/1991 Haffey et al. ..... 24/633
5,067,212 A * 11/1991 Ellis ..... 24/633
5,267,377 A 12/1993 Gillis et al.
5,283,933 A 2/1994 Wiseman et al.
5,406,681 A 4/1995 Olson
5,416,957 A * 5/1995 Renzi et al. ..... 24/633
5,568,676 A 10/1996 Freeman
5,588,189 A 12/1996 Gorman et al.
6,329,893 B1 * 12/2001 Furukawa et al. ..... 335/205
6,381,815 B1 * 5/2002 Yamaguchi et al. ..... 24/633

* cited by examiner

*Primary Examiner*—Robert J. Sandy
(74) *Attorney, Agent, or Firm*—Richard A. Speer; Mayer, Brown, Rowe & Maw LLP

(57) ABSTRACT

The present invention provides a buckle and frame for a restraint system resisting to a harsh environment. The buckle comprising a frame having a base wall, the base wall includes a debris exit opening; and a cover which encloses the frame and forms at least one vent opening and at least one passage which couples the debris exit opening to the vent opening. Debris, dust and other foreign objects which find there way into the buckle are not necessarily trapped but rather are presented with a means of exiting the buckle via the vent opening.

9 Claims, 13 Drawing Sheets

BUCKLE AND FRAME FOR RESTRAINT SYSTEM RESISTANT TO A HARSH ENVIRONMENT

FIELD OF THE INVENTION

The invention relates, generally, to a safety restraint system having a buckle and tongue and, more particularly, a belt restraint system for restraining an individual in a seat having a buckle and tongue adapted for use in a harsh environment.

BACKGROUND OF THE INVENTION

Commercially viable applications of the invention include, for example, off-road applications such as recreational equipment (go-karts, dune buggies, all terrain racing, etc.), cargo tie-down industry, heavy equipment applications, forklift or material handling equipment, and agricultural equipment.

The prior art safety restraint systems includes combination buckle and tongue devices incorporated in a belt or webbing system to safely secure an individual or occupant in a seat. Many of the prior art systems include a locking mechanism having a frame and a pawl for locking the tongue to the frame.

U.S. Pat. No. 3,921,262 discloses a load bearing safety belt buckle construction. The buckle includes a housing having a latch plate with a cam surface. A tongue plate having an abutment surface is inserted into the housing whereupon a spring urges the cam surface to engage with the abutment surface. U.S. Pat. No. 5,267,377 discloses a multi point buckle assembly. The buckle assembly includes a metal base. A latch member includes a latch lug biased by a latch spring for engaging an opening of a tongue.

Safety restraint systems for use in a harsh environment, such as off-road or earth moving equipment, are subject to particular problems. For example, the prior art buckle assembly frame acts in an enclosing manner that houses the sliding button and traps dust and debris between the button surfaces and the frame surfaces.

The ejection slide provides a plastic-on-plastic arrangement. Such an arrangement may suffer from galling due to the harsh dusty environment. The cover of certain prior art systems include features which introduce horizontal ledges which allow dust and debris to settle and accumulate thereupon and which eventually may gall internal components of the system. The size of the button face area is relatively small and obstructed too easily to activate, particularly by someone wearing heavy working gloves.

The prior art systems suffer other disadvantages. For example, the portion of the sliding button which acts upon the locking pawl engaging device is not sufficient. In addition, the button portion does not provide a backup in the event the primary device fails.

SUMMARY OF THE INVENTION

It is an object of the present invention to provide a buckle for a safety restraint system adapted for harsh environments, such as abusive handling, moisture, corrosion, dust and debris.

It is a further object of the present invention to provide a buckle for a safety restraint system especially adapted to be used in off-road or earth moving equipment.

It is a further object of the present invention to reduce the number of components required.

It is a further object of the present invention to provide a buckle for a restraint system designed to allow dirt and debris which has gotten into the buckle, the ability to easily pass through and exit the buckle.

The present invention therefore provides a buckle for a restraint system resistant to a harsh environment. The buckle comprising a frame having a base wall, the base wall includes a debris exit opening; and a cover which encloses the frame and forms at least one vent opening and at least one passage which couples the debris exit opening to the vent opening. Debris, dust and other foreign objects which find there way into the buckle are not necessarily trapped but rather are presented with a means of exiting the buckle via the vent opening.

The present invention also provides a one piece frame used in a buckle for a restraint system resistant to a harsh environment. The frame having a base wall, a pair of opposed facing side walls, and a pair of flanges. The base wall having a debris exit opening. The pair of opposed facing side walls extending up from the base wall, each side wall having a tab deformed inward and in opposed facing relation with the tab on the other side wall, each of the tabs has a lower edge which forms an upper limit of a guide for the tongue when it is inserted into the frame, and when the tongue is not inserted the lower edge forms an upper limit for a latch plate. The pair of flanges extending toward one another from the side walls in a common plane, the flanges adapted for receiving a button release slide adapted to release a tongue from the frame, each flange having a notch, whereby sliding action of button release slide causes dirt and other debris to fall through the notch and avoid being lodged between the flange and the button release slide.

The present invention further provides a buckle for a restraint system resistant to a harsh environment. The buckle having a frame, tongue, latch plate and a leaf spring. The frame having a base wall, the base wall including a front edge at a mouth of the buckle. The tongue having one end for insertion into the frame, the one end having an opening and forming a pawl engaging inner face. The latch plate having a front edge which is pivotally coupled at the front edge of the frame, and a pawl located on a side opposite from the front edge for engagement with the pawl engaging inner face. The leaf spring having a first end which is secured to the buckle at the mouth, and a mid portion located under the latch plate and which urges the latch plate upward and away from the base wall into a locked position, and another end having an elbow which rests upon the base wall and extends upward from the base wall to form a tongue engaging end, whereby when the tongue is inserted into the frame, the latch plate is urged downward against the base wall and against the force of the leaf spring, further insertion of the tongue causes the one end of the tongue to come in contact with the tongue engaging end, and wherein further insertion of the tongue causes the tongue engaging end to deflect and load the tongue under spring force, and wherein further insertion of the tongue causes the pawl engaging inner face to slide over the pawl at which time the pawl is urged upward by the leaf spring and engages with the pawl engaging inner face, thus whereupon subsequent downward movement of the latch plate causes the spring loaded tongue engaging end of the leaf spring to urge the tongue out of the buckle.

The present invention also provides a buckle for a restraint system resistant to a harsh environment. The buckle having a frame, tongue, button release slide, latch plate and a leaf spring. The frame having a base wall, the base wall including a front edge at a mouth of the buckle The tongue having one end for insertion into the frame, the one end having a pawl engaging inner face. The button release slide slideably secured to the frame and adapted to release the tongue from the frame, the button release slide having a pair of depending inner legs at one end, the depending legs each presenting an inclined surface. The latch plate having a front edge which is pivotally coupled at the front edge of the mouth, and a pawl located distal from the front edge for engagement with the pawl engaging inner face, and an upwardly inclined surface located distal from the front edge of the latch plate. The leaf spring having a mid portion located under the latch plate and which urges the latch plate upward and away from the base wall into a locked position, whereby when the tongue is inserted into the frame, the latch plate is urged downward toward the base wall and against the force of the leaf spring, and wherein further insertion of the tongue causes the pawl engaging inner face to slide over the pawl at which time the pawl is urged upward by the leaf spring and engages with the pawl engaging inner face, and whereupon subsequent actuation of the button release slide causes the pair of depending inner legs to urge the upwardly inclined surface of the latch plate downward against the spring force of the leaf spring so as to disengage the pawl from the tongue.

The present invention further provides a buckle for a restraint system resistant to a harsh environment. The buckle having a housing, a tongue and a compressive spring mechanism. The buckle housing having a mouth opening and a latching mechanism. The tongue having one end for insertion into the mouth opening for engagement and latching with the latch mechanism. The compressive spring mechanism secured to the tongue and arranged to be compressed as the tongue is inserted into the mouth opening, whereby upon release of the tongue from the latching mechanism, the tongue is urged out of the mouth opening under the compressed spring force of the latch mechanism.

DETAILED DESCRIPTION OF THE INVENTION

Figure 1:
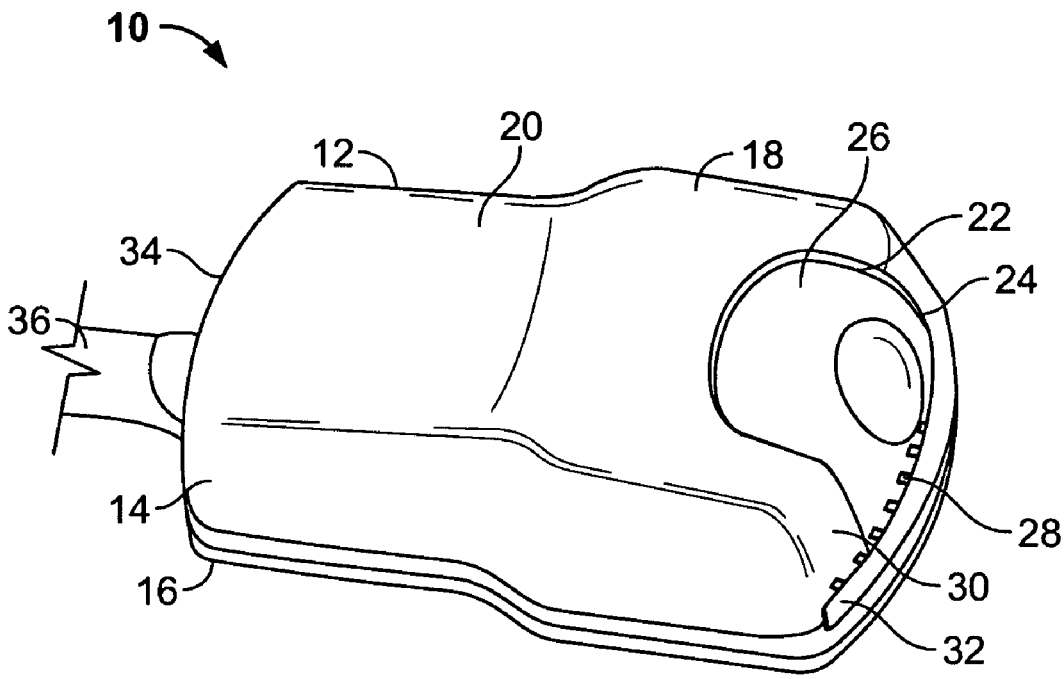
FIG. 1 is a perspective view of the buckle of a first preferred embodiment of the present invention.

FIG. 1 shows a perspective view of a buckle 10 in accordance with a first preferred embodiment of the present invention. The buckle 10 includes a cover 12 having an upper portion 14 and a lower portion 16. The upper portion includes a first top surface 18 which is raised with respect to a second top surface 20. The first top surface of the cover includes a cutout 22 to accommodate a button face 24. The button face includes a top surface 26 and a front surface 28 which is essentially at a right angle to the top surface of the button face. The upper portion of the cover also includes a front surface 30. The cover when assembled forms a mouth or vent opening 32 at a front end and a vent opening 34 at a rear end. A cable 36 can be seen to extend from the rear end of the cover.

Figure 2:
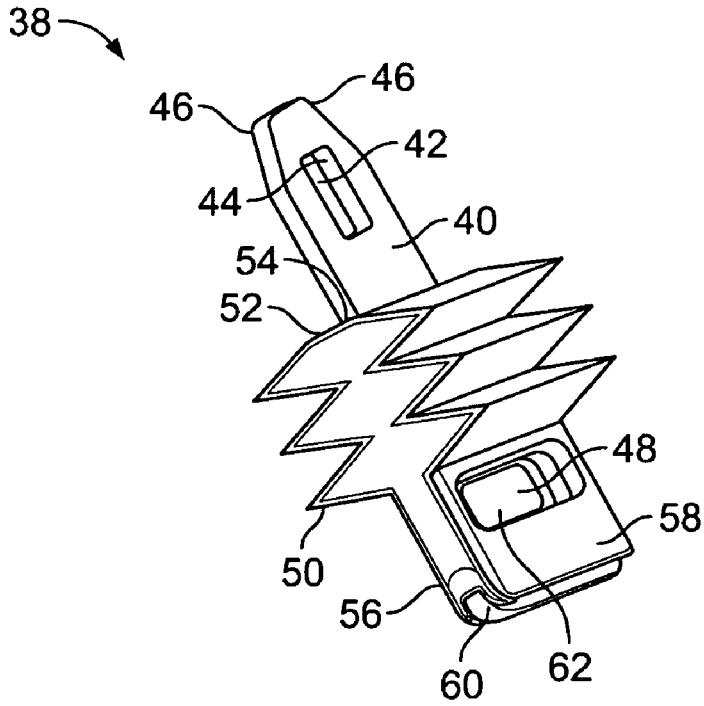
FIG. 2 is a perspective view of a connector which is used with the buckle of FIG. 1.

FIG. 2 shows a perspective view of a connector 38 for use with the buckle of FIG. 1. At one end of the connector, a tongue 40 is provided having an opening 42 which forms a pawl engaging inner face 44. The tongue also includes a first and second angled surface 46. The other end of the connector includes a belt slot 48 for receiving a belt or other securing material (not shown). The angled symmetric surfaces 46 help guide the connector plate more easily into the buckle. The symmetry of the connector allows the connector to be attached to the buckle irrespective of the orientation. A bellow 50 includes a first end 52 having an opening 54 and a second end 56 having a rectangular sleeve portion 58 with an open end 60. The bellow surrounds a substantial portion of the connector and the sleeve portion includes two openings 62 which are aligned with the belt slots. The connector is coupled with the buckle by means of the tongue being inserted into the mouth. When the connector is inserted into the buckle, the bellow is compressed by the front surface of the cover and develops a spring force urging the locked connector in a direction out of the buckle.

Figure 3:
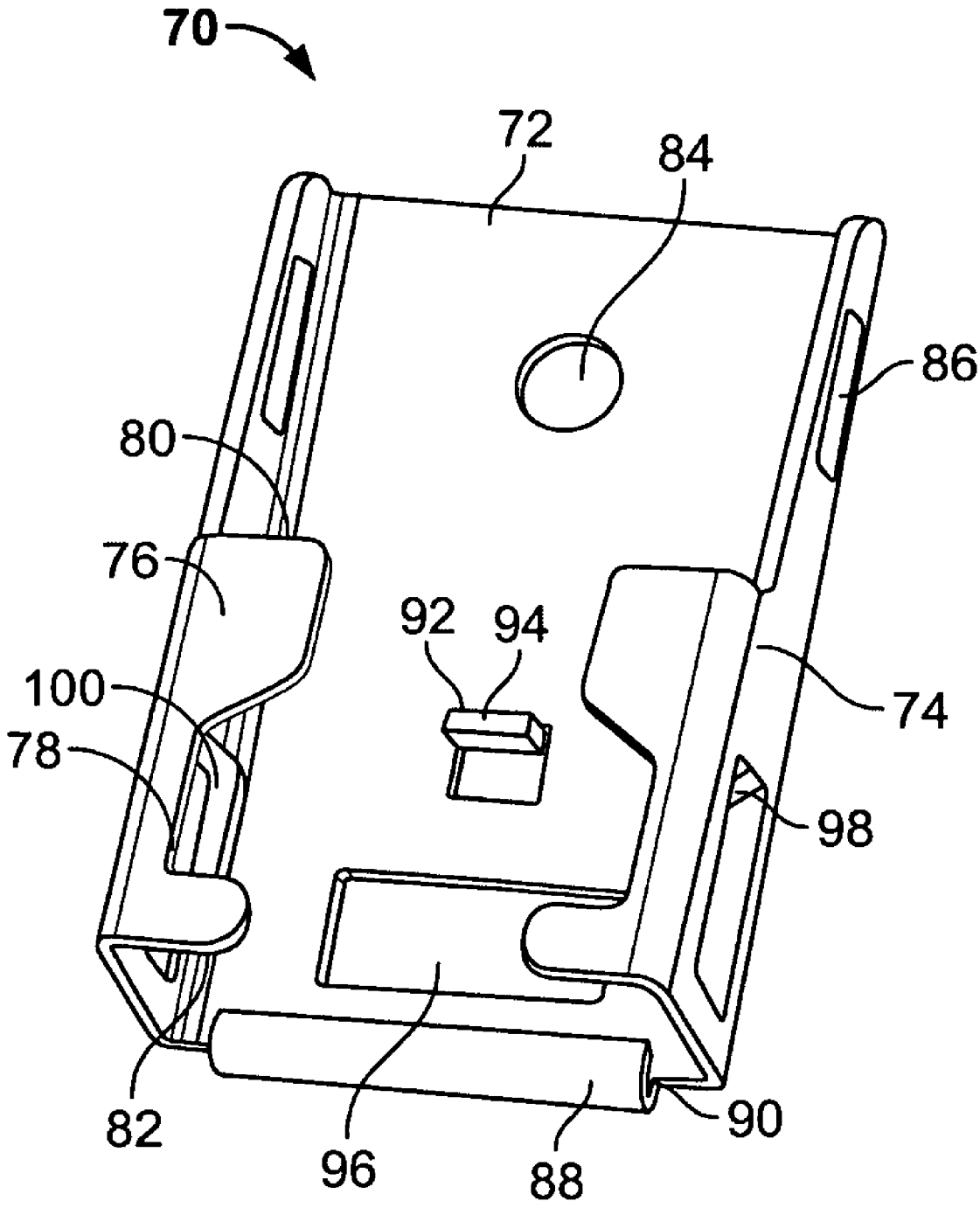
FIG. 3 is a perspective view of a frame incorporated in the buckle of FIG. 1.

FIG. 3 shows a frame 70 which is used in the buckle of FIG. 1. The frame includes a base wall 72 and two side walls 74 which extend up from the base wall. A pair of inclined flanges 76 are provided at the top of the side walls and extend towards one another in a common plane. The inclined flanges each include a notch 78. The flanges each include an edge 80 facing the rear of the frame. The flanges also include a leading edge at the front of the frame. A large radius on the leading edge 82 of the topward surface of buckle frame is included to assist in smooth interaction. The base wall includes a hole 84 for connecting the cable to the buckle. The side walls further include a pair of opposed facing slots 86 which assist in the connection of the cable to the buckle. The base wall includes a front edge 88 which is bent and curled so as to be redirected towards the rear of the frame and form a recess 90. A tab 92 is bent up from the base wall and extends upwardly terminating at an end 94. The base wall further includes a debris exit opening 96. The side walls each include a tab 98 deformed inwardly. The side wall tabs each include an upper edge 100 and a lower edge 102 (FIG. 4).

Figure 4:
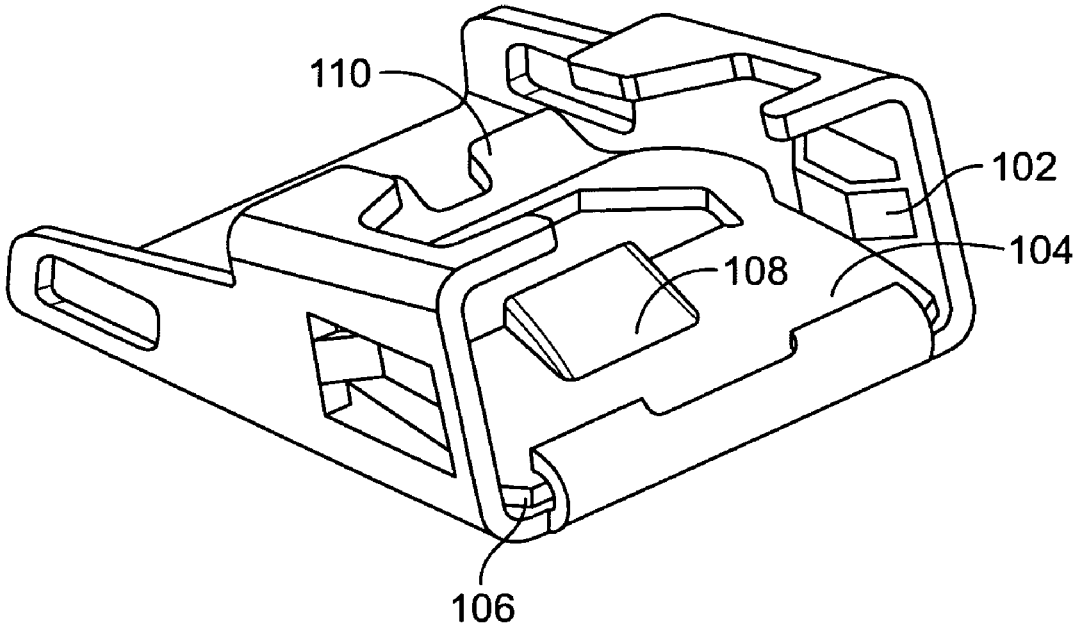
FIG. 4 is a perspective view of a frame incorporated in the buckle of FIG. 1, shown together with a latching plate.

FIG. 4 shows the frame of FIG. 3 but further with a latch plate 104. The latch plate includes a front edge 106 which is received by the recess of the frame. The latch plate further includes a raised pawl 108 and a pair of upwardly inclined surfaces 110. The partial side view of FIG. 4 better demonstrates that the inclined flanges are oriented to slope down toward the back of the buckle or frame. The latch plate of FIG. 4 is shown to be pivoted at the recess so that the upwardly inclined surfaces are in a raised or locked position and in contact with the lower edge of the deformed tabs. However, when the latch plate is lowered, the lower edges of the deformed tabs together with the curved front edge of the frame and the side walls define a guide or channel for receiving the tongue.

Figure 5:
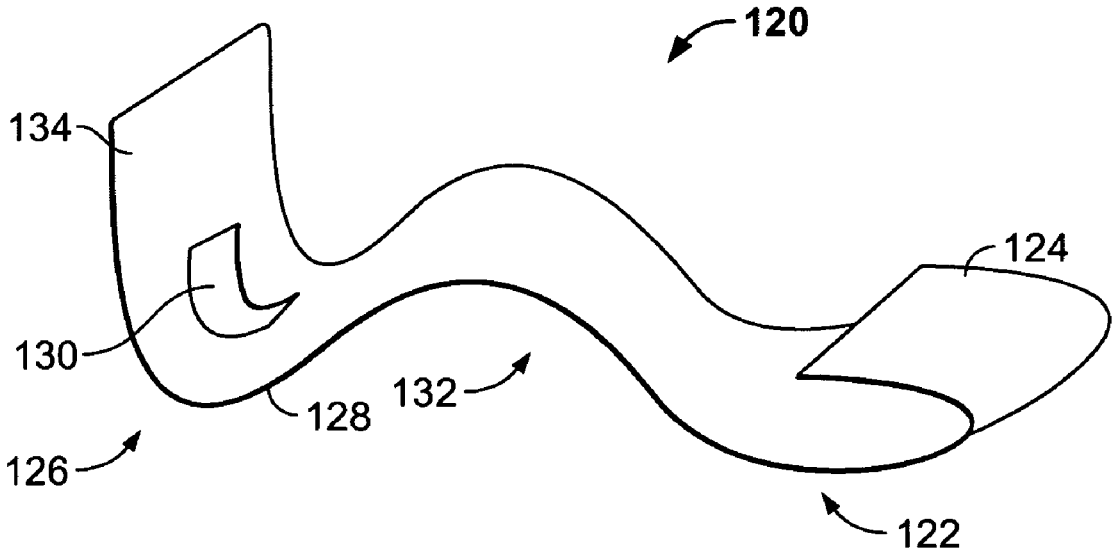
FIG. 5 is a perspective view of a leaf spring incorporated in a second preferred embodiment of the present invention.

FIG. 5 discloses a leaf spring 120 for use in an alternative preferred embodiment of the present invention. However, the leaf spring of FIG. 5 is actually a modified version of the leaf spring used in the first preferred embodiment of the present invention. The leaf spring of FIG. 5 will now be described in connection with its use in the first preferred embodiment of the present invention. The leaf spring includes a first end 122 having a curved end or hook portion 124 which is used to receive the front edge of the latch plate. A second end 126 includes an elbow 128 having a hole 130. The hole receives the tab which extends up from the base wall of the frame. Thus the curved end and hole of the leaf spring restrain the leaf spring within the frame. An arched mid portion 132 of the leaf spring extends under the latch plate and urges the latch plate in an upward and locked direction. In the embodiment of FIG. 1, an optional tongue engaging end 134 is not used and therefore the second end is shortened and does not extend as high as shown in FIG. 5. A required height of the second end for each embodiment will be understood from the description which follows.

Figure 6:
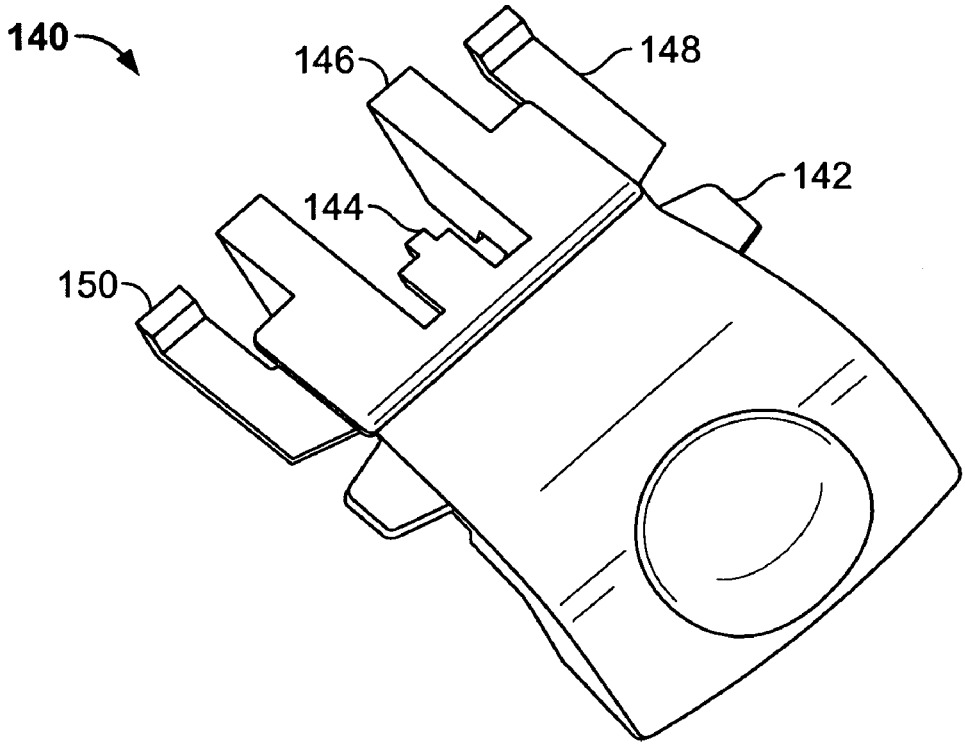
FIG. 6 is a perspective view of a button release slide of the buckle of FIG. 1.

FIG. 6 discloses the button release slide 140 which includes the button face, a pair of wing style tabs 142 extending from the sides and a spring boss 144 which extends from the back of the button release slide. A pair of depending inner legs 146 are shown, as well as a pair of outer legs 148 which each include a stop 150.

Figure 7:
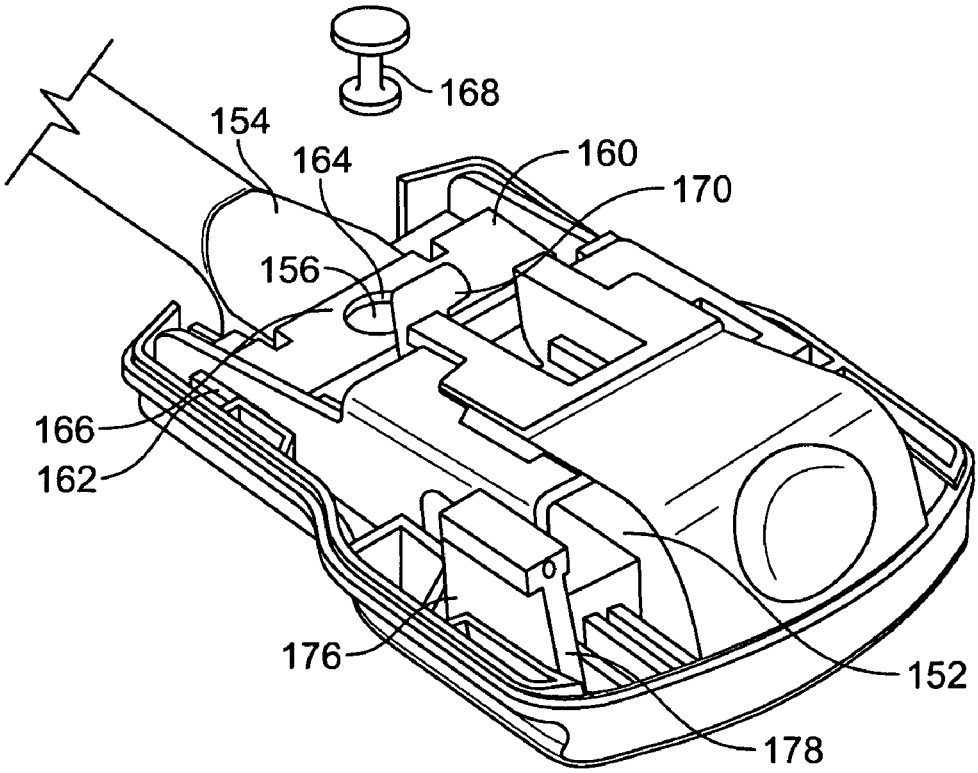
FIG. 7 is a perspective view of the buckle of FIG. 1, with the upper portion of the cover removed.

FIG. 7 shows the frame and other components received by the lower portion of the cover. It can be seen that the button release slide includes grooves 152 on either side which receive the inclined flanges. The button release slide is able to slide back and forth with respect to the frame along the flanges. The cable is shown to include a cable end fitting 154 which includes a hole 156 which is aligned with the hole of the frame. A bracket 160 is shown having ends 162 which extend through the slots of the frame. The bracket further includes a hole 164 in a mid portion 166 which is aligned with the hole of the cable end fitting and the hole of the frame. A fastener 168 is used to secure the cable end fitting between the frame and bracket. A button spring retainer or end 170 extends up from the mid portion of the bracket and is aligned with the spring boss of the button release slide. A spring 172 (FIG. 8) extends between and is captured by the button spring retainer and spring boss. The spring urges the button release slide outwardly from the mouth of the buckle towards a locked position. The bracket further includes downwardly bent tabs 174 (FIG. 8) on either side of the cable end fitting so as to further secure the cable end fitting in position. A switch 176 is also shown in the lower portion of the cover and includes a pivotal switch arm 178.

Figure 8:
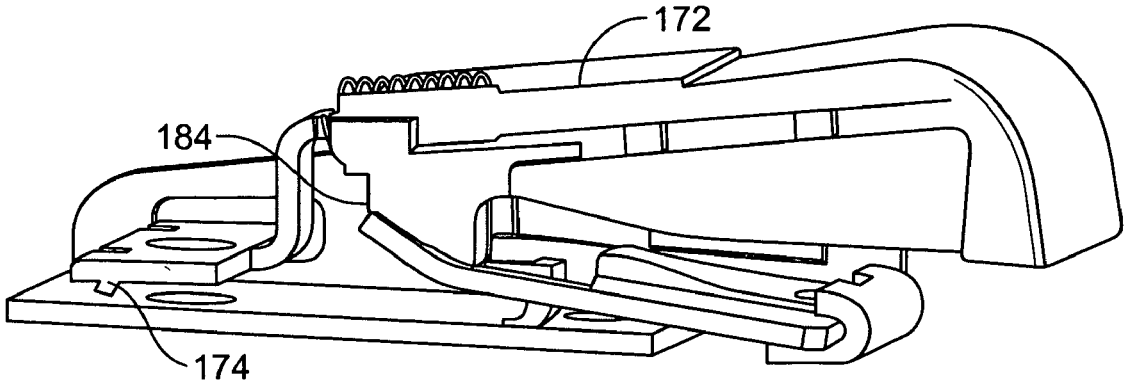
FIG. 8 is a partial cross section and cutaway side view of FIG. 7, with the latch plate in the locked position.

FIG. 8 shows a partial cutaway cross section side view of the frame and button release slide as well as other components. The button release slide is shown biased by the spring in the outwardly extending position. The outer legs are shown to include a depending inclined surface 184 which is in engagement with the upwardly inclined surface of the latch plate. The position of the button release slide shown in FIG. 8 allows the latch plate to be urged by the leaf spring (not shown in FIG. 8) in an upward locked position. It will be noted that in the locked position the pawl extends above the end of the tab bent upwardly from the base wall.

The following describes the tongue being inserted into the buckle with the button release slide in the extended locked position. It will be appreciated that if the tongue is inserted into the mouth of the buckle, the tongue will extend over the front edge of the frame and below the lower edge of the deformed tabs. As the tongue is further inserted, the end of the tongue will come into engagement with the latch plate and urge the latch plate to pivot downward against the force of the leaf spring. Eventually the tongue will come into contact with the end of the upturned tab. Further insertion of the tongue will cause the inner face of the tongue to pass the pawl at which time the latch plate will be urged upward by the leaf spring and the pawl will come into contact with the inner face of the tongue and latch the tongue with the buckle.

Figure 9:
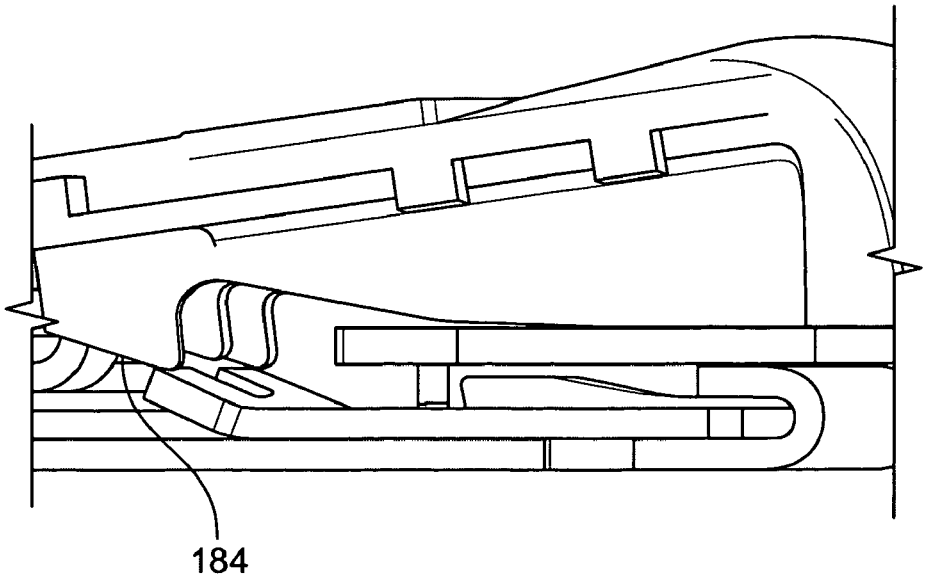
FIG. 9 is a close-up of FIG. 8, but with the latch plate in the unlocked position.

FIG. 9 shows the button release slide having been depressed, such as by the user, and moved in a direction to the left as viewed in FIG. 9. The inclined surface of the outer legs slides against the upwardly inclined surface of the latch plate, urging the latch plate to pivot or rotate in a downward direction together with the pawl against the force of the leaf spring (not shown in FIG. 9). The release slide will continue to travel on this path until the upper frame edge runs into the end of the groove in the side of the button. This groove has a maximum amount of travel built in to keep the operator from over traveling the locking pawl, as well as to constrain or hold the release slide component in a particular orientation. When the release slide reaches the maximum amount of travel, the locking pawl will be rotated to the unlatched position, which is slightly beyond the position actually required for the connector to be released. As the tongue is prevented from moving downward with the pawl as a result of engagement with the end of the upward bent tab, eventually the pawl will be removed from engagement with the inner face of the tongue. At this point, the latch plate is in the unlocked position and the compression force of the bellow will assist in urging the tongue out of the buckle.

There is an added feature to the function of the button release slide, and the actuation of releasing the buckle assembly. The wing style tabs on each side of the button slide forward and backward as the button face is depressed and released. As the component moves in this fashion the wing style tabs act in a sweeping fashion. It is intended that this function sweep and clear any dust and debris out of the channel located in the side of the button. The wing style tabs work together with the two notches purposely cut into the top surface of the buckle frame. As the wings sweep back and forth they carry or push any dust and debris past said notches or vented openings to clear the sliding path of the button release component. This sweeping action occurs every time the release button is depressed or released. This function takes place independent of the locking mechanism. Grooves in the slide of button are designed to have large amounts of clearance to allow for ease of dirt and debris to be swept past and eject through notches in the frame; in essence slots are much larger than thickness of frame.

The inclined flanges minimize size and material, improves on industry standard devices orientation for ergonomic release by operators, and minimize the release stroke and overall travel of the button release slide.

Figure 10:
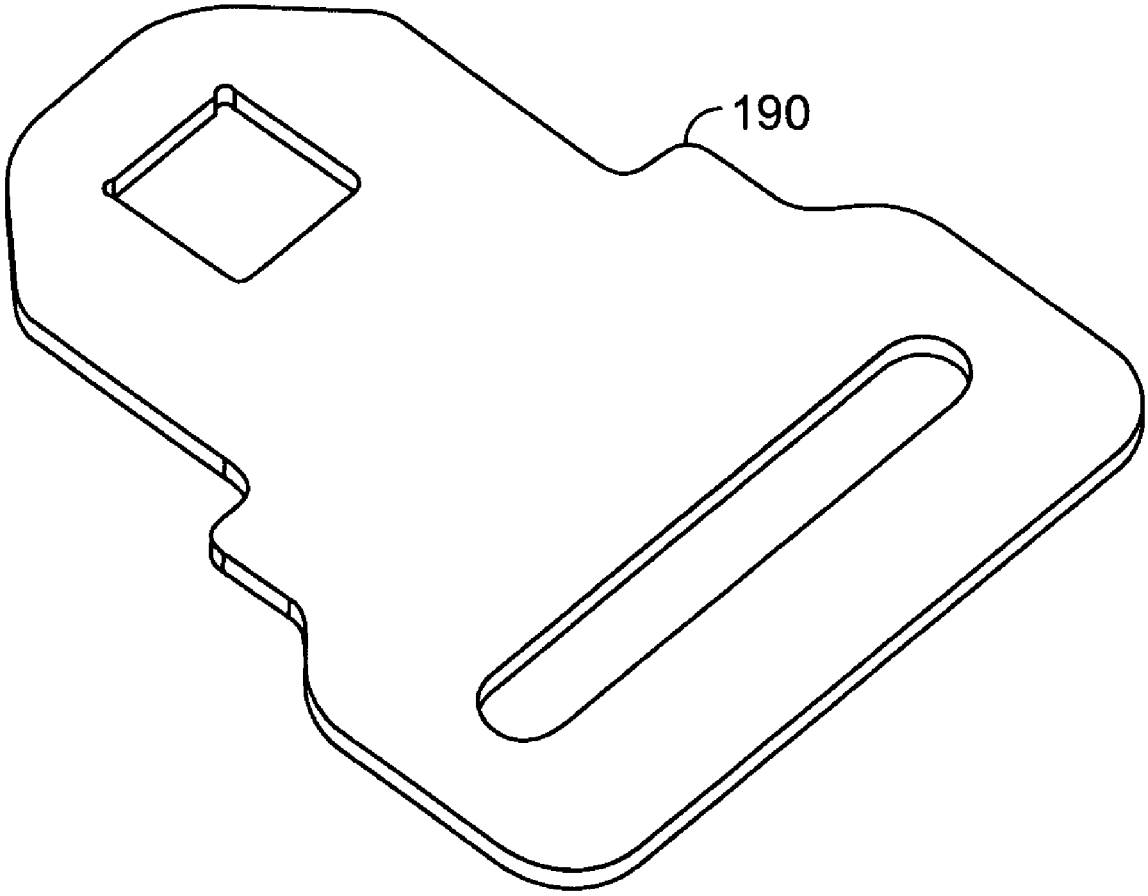
FIG. 10 is a perspective view of a connector of FIG. 2 but shown without the bellow.

FIG. 10 shows the connector as used in both the embodiment shown in FIG. 2 as well as the embodiment which does not include the bellow but rather includes the leaf spring as shown in FIG. 5 together with the optional tongue engaging end. The connector is shown to include shoulders 190 on either side. It will be appreciated that regardless of which embodiment of the connector is used, with the connector inserted in the buckle, and regardless of the orientation of the connector with respect to the buckle, one of the shoulders will come into engagement with the pivotal switch arm of the switch, thus activating the switch and developing a signal to indicate that the connector is fully inserted in the buckle.

Figure 11:
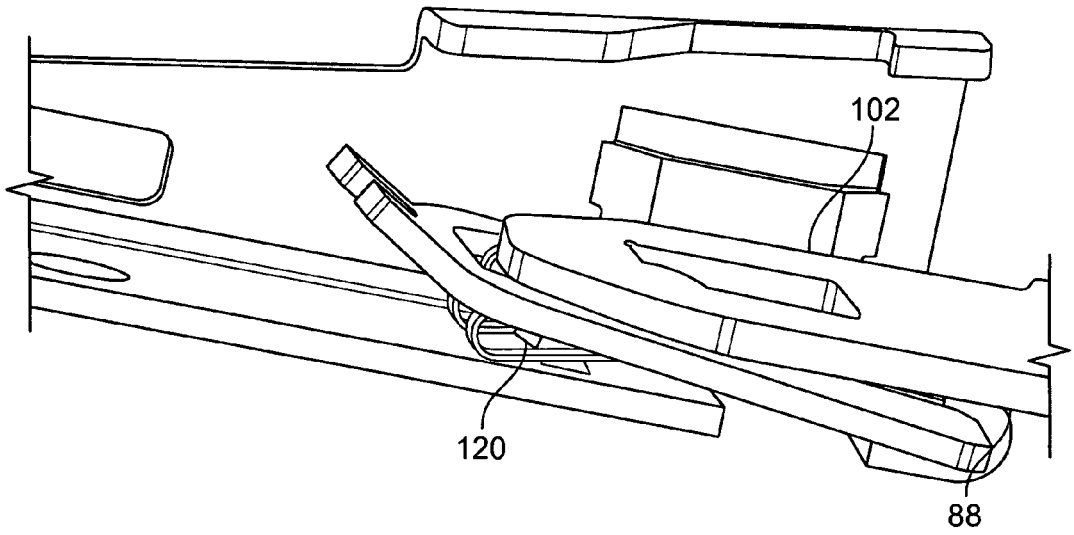
FIG. 11 is a partial cutaway and cross sections side view of the frame, a latch plate and tongue of the second preferred embodiment of the present invention.

FIG. 11 shows a partial cutaway cross section side view of the frame and other components of the second preferred embodiment of the present invention. The frame is shown with the tongue inserted with the inner face in locking engagement with the raised pawl. The latch plate has been urged downwardly by the insertion of the tongue. The leaf spring is shown to be in position with the tongue engaging end in engagement with the tongue. It will be appreciated that for the second preferred embodiment, the tongue engaging end must extend above the end of the tab. When the tongue is initially inserted, it comes into engagement with the tongue engaging end, and is further inserted into the buckle so as to depress the tongue engaging end away from the mouth of the buckle and thereby loading a spring tension force against the tongue. However, the engagement of the tongue with the pawl prevents the tongue from being urged out of the buckle by means of the tongue engaging end of the leaf spring. FIG. 11 shows that the tongue is guided by means of the lower edge of the inwardly deformed tab and the front edge of the frame.

Figure 12:
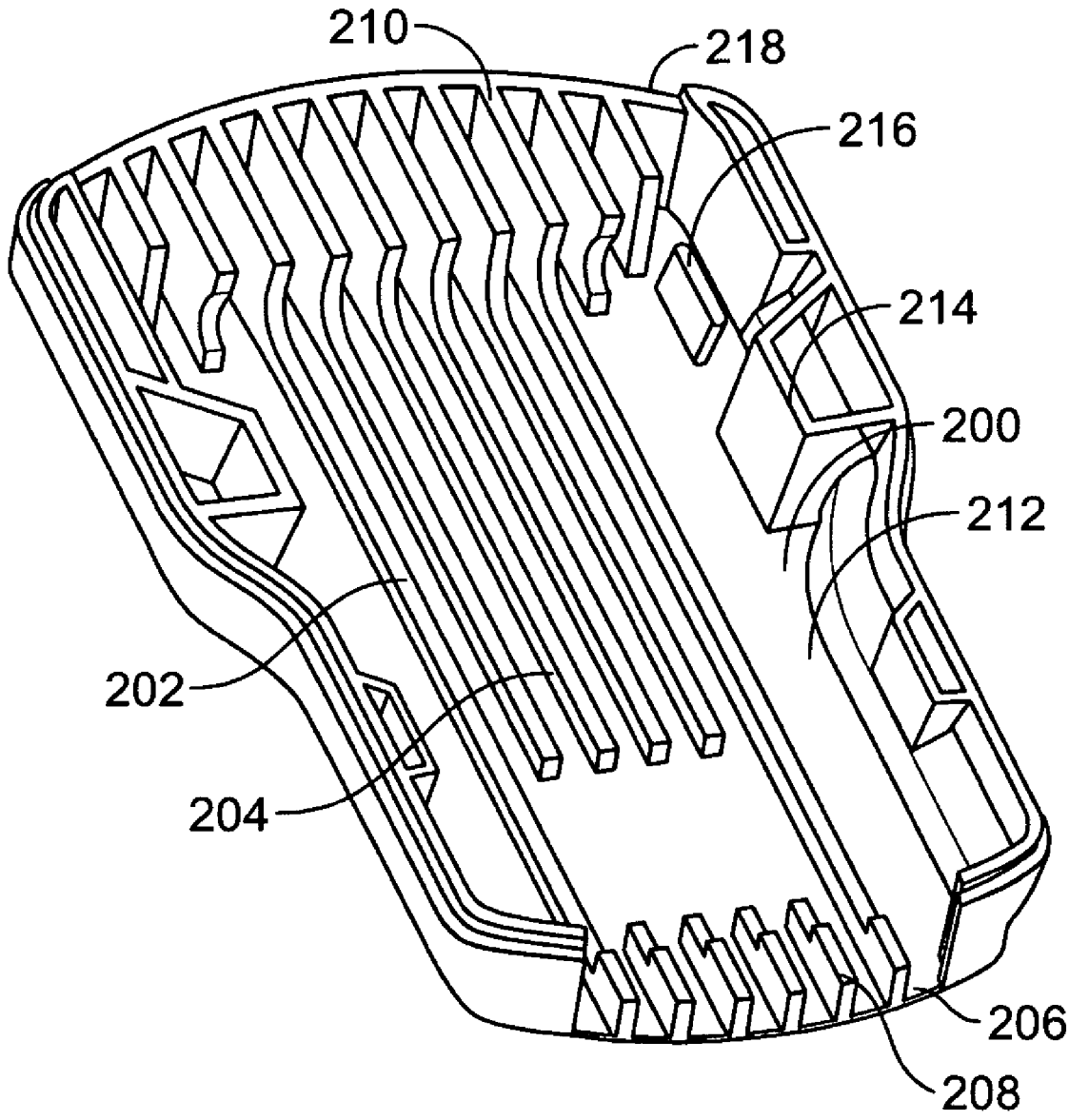
FIG. 12 is a perspective view of the lower portion of the cover of FIG. 1.
Figure 13:
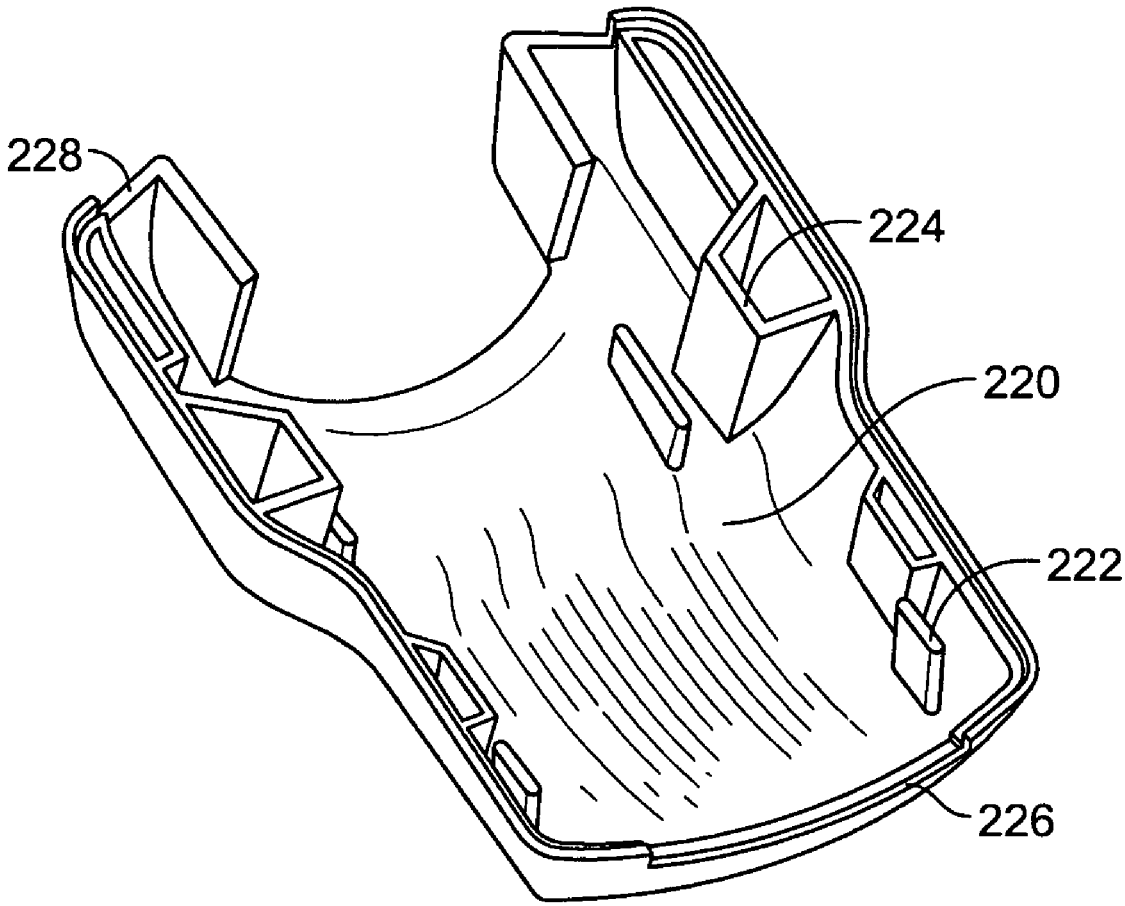
FIG. 13 is a perspective view of a upper portion of the cover of FIG. 1.
Figure 14:
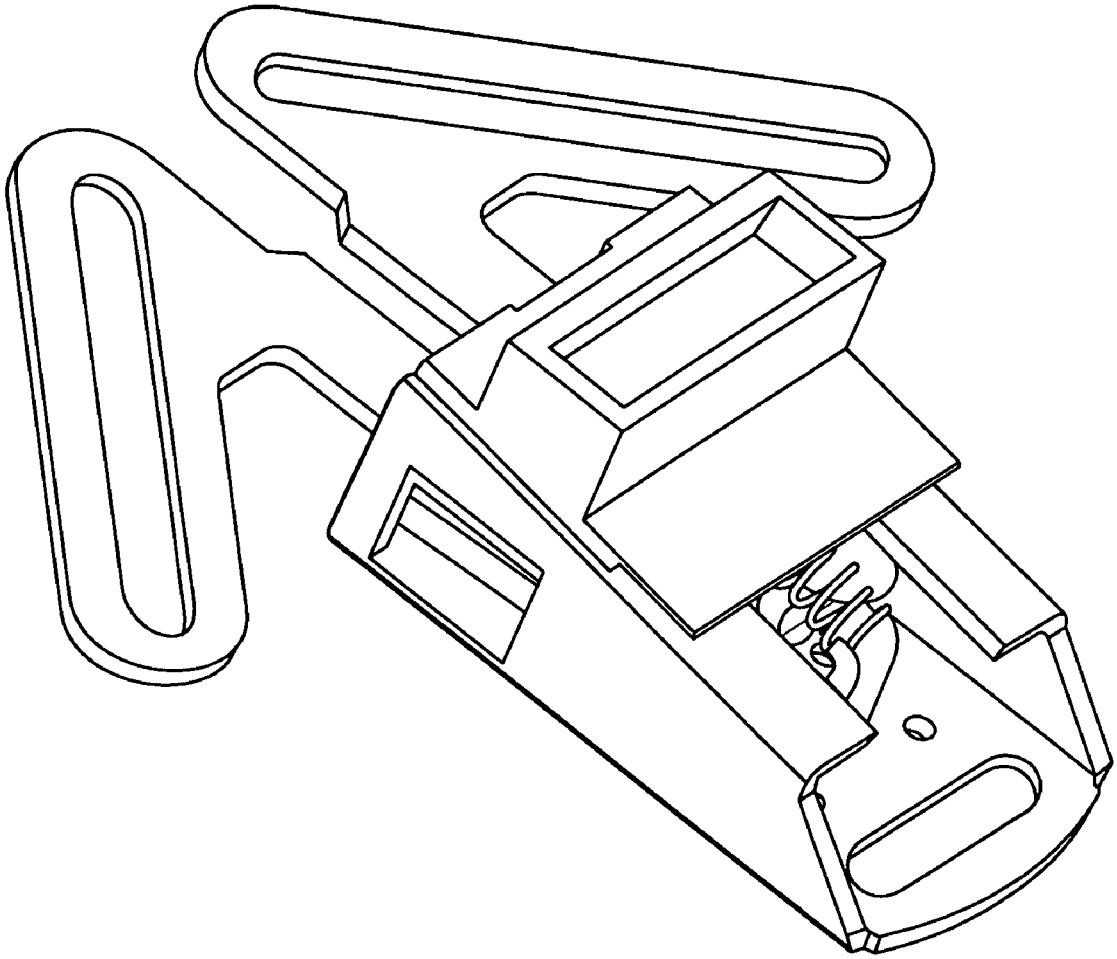
FIG. 14 is a perspective view of a buckle and connector assembly of a preferred alternative embodiment of the present invention.
Figure 15:
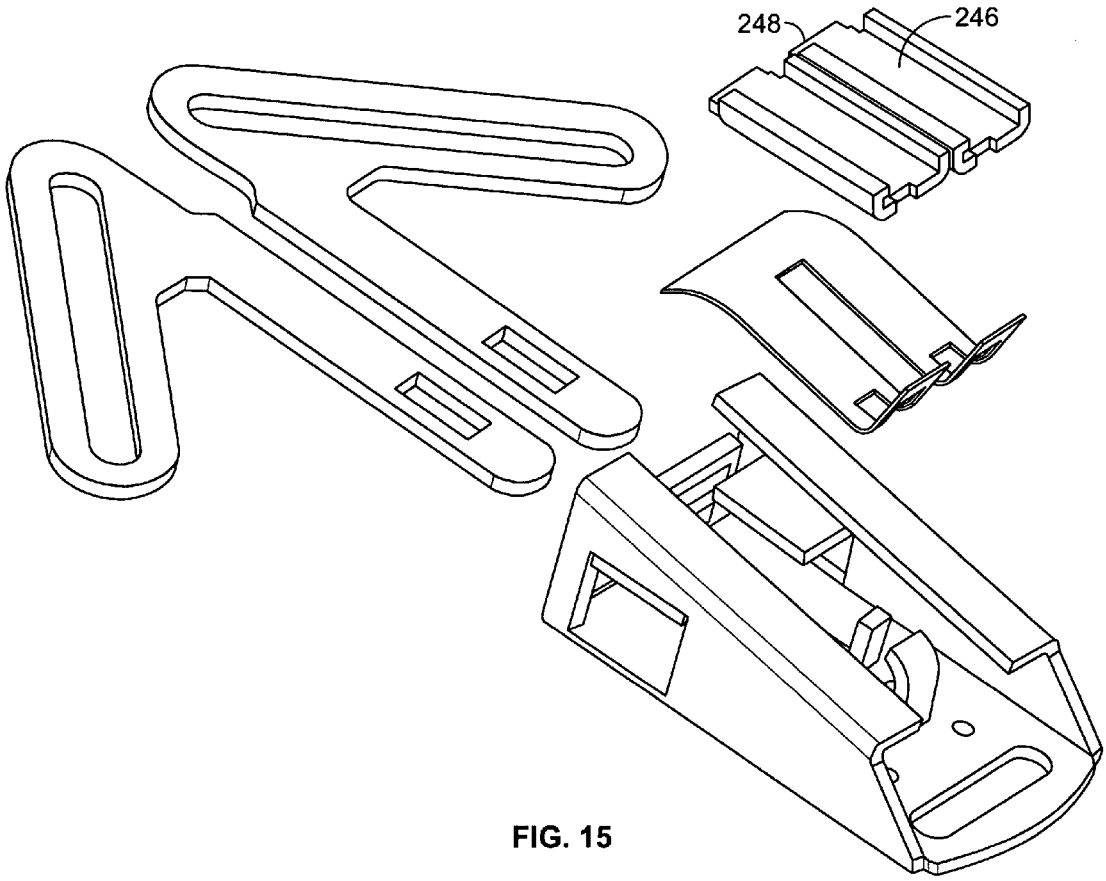
FIG. 15 is an exploded view of the buckle assembly of FIG. 14.
Figure 16:
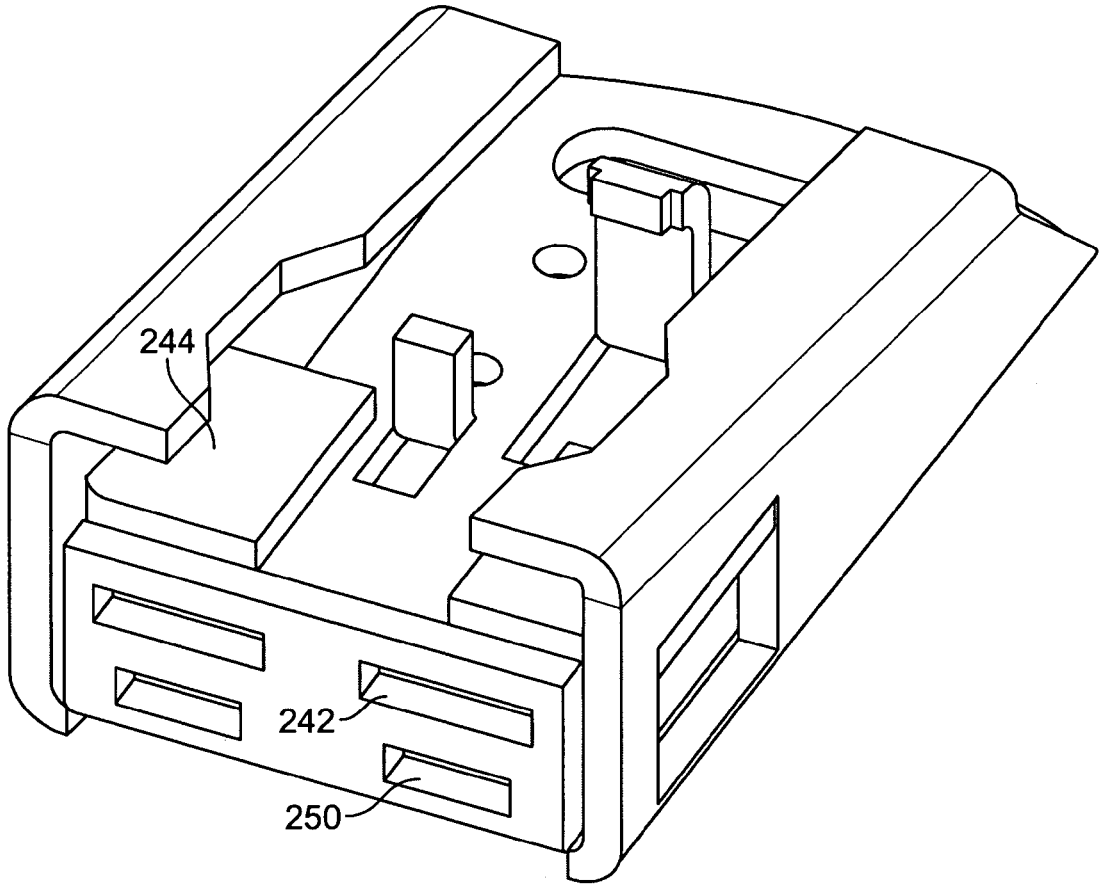
FIG. 16 is a perspective view of the frame of the buckle of FIG. 14.
Figure 17:
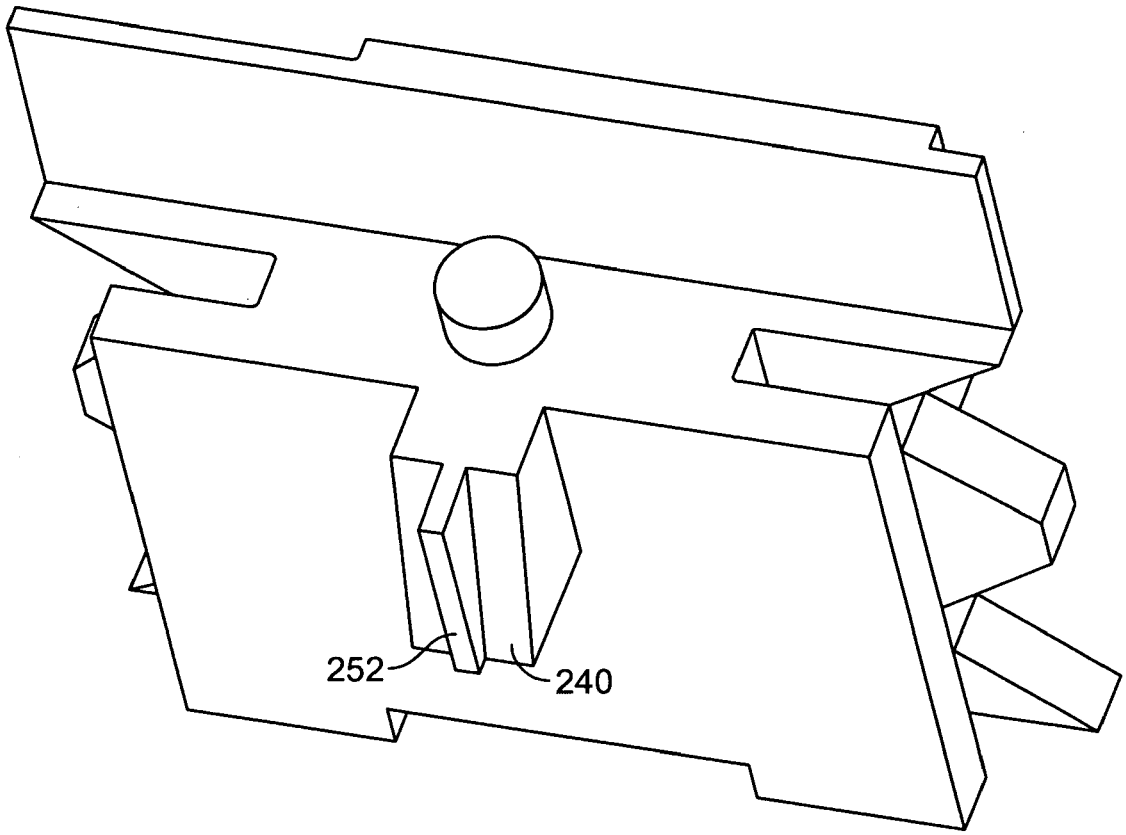
FIG. 17 is a perspective view of the button release slide of FIG. 14.

FIG. 12 shows the lower portion of the cover. The lower portion includes an inner face 200 upon which support ribs 202 extend along a length thereof. Channels or passageways 204 are formed between the adjacent support ribs. A cutout 206 of the lower portion defines a portion of the vent opening perimeter. A first raised area 208 and a second raised area 210 of the ribs form a recess 212 which receives the frame. Support walls 214 further define the recess and maintain the position of the frame. The second raised area of ribs will be in general alignment with the front edge of the frame and thus assist together with the button release slide in providing a guide or channel for the entrance of the tongue. A switch support rib 216 is further shown to secure the switch to the cover. A cutout 218 forms part of the perimeter for the mouth 32. FIG. 13 shows the upper portion of the cover having an inner face 220 and similarly providing support ribs 222 and support walls 224. A cutout 226 defines a portion of the vent opening perimeter. Another cutout 228 defines a portion of the perimeter of the mouth 32 The cover design intentionally bias dust and debris to the center of buckle and urge it to exit opening in back.

FIGS. 14–17 disclose a preferred alternate multi-point embodiment. The operation of the multi-point embodiment is much like the operation of the preferred embodiment. The major difference is that multiple pawls are used, one pawl for each connector. In the case of FIGS. 14–17, two connectors are used, thus two pawls are used. A button release slide is still used to push the pawls into the unlatched position against the pawl leaf springs that urge the pawls toward the latched position. For the purpose of explaining the nuances and differences of the operation of the multi-point embodiment as compared to the preferred embodiment, no description of the covers is included because the same features are used as described earlier.

FIGS. 14–17 show that the overall design of the multi-point embodiment is similar in that the button release slide rides on inclined flanges that are bent inward from the sidewalls. The ramps provided on the button release slide are used to depress the pawls to the unlatched position as the user pushes the button in the rearward direction against the urging of the leaf spring.

In use, webbing is placed through web slots so that the buckle can be used in three-point or five-point restraint applications. The terms "three-point" and "five-point" refer to the number of anchorage points built into the restraint system. For example, in a five-point restraint, anchorage points are located as follows: one for each shoulder, one in front of the crotch, and one on each side of the hips. Webbing is placed through eyelet holes at each seat anchorage point and through the three web slots on the buckle device.

To lock the multi-point buckle, either the connectors can be latched simultaneously or separately. The leaf spring urges the pawls to the latched position. When the user pushes the connector through the connector entry slot 242 and in between the guidance flanges 244, the connector acts as a wedge which forces the pawl downward to the unlatched position against the pawl spring until the leaf engaging slot passes over the pawl tang and until the pawl engaging inner face goes far enough until the leaf spring can force the pawl upward so that the pawl engagement face protrudes into the pawl engaging slot and blocks the connector from backing out of the mechanism. Since each pawl works independently, each connector can be pushed in the same manner.

Another feature of the pawl is that it includes upward bent walls to create a guide way 246 for the connector. The preferred embodiment guides the connectors by use of the frame sidewalls. Since multiple pawls may be in this system, multiple walls are needed for connector guidance, therefore the guidance is built-in to each pawl. The pawls rotate about an imaginary axis through the hinge boss 248 and hinge hole 250.

To prevent sideways movement of the pawls, a separator 252 is included on the button release slide. When the mechanism is assembled, this feature is located between the pawls and provides the lateral support need so that if sideways loads are placed on the connectors, the separator 252 will prevent the connectors and pawls from moving and possible disconnecting prematurely.

This embodiment also has the dust sweeping features built into the frame and the button release slide. The notches allow the release of dust and debris as the wing style tabs move over the inclined flanges when the user pushes the button release slide.

Since this embodiment would not be attached to a cable, the button spring retainer is included as a part of the frame. Also, the pawls springs are held in the mechanism by the pawl spring retainer.

There are many features within the internal design of the cover that are associated with the funneling and biasing of dust and debris through and out of the system. The features include the two protruding sets of support walls to brace the sides of the buckle frame, and at the same time not introduce a ledge for dust and other foreign objects to settle onto. This is accomplished by introducing a ramp on all support walls that protrude in a direction normal to the sidewalls of the buckle frame. Note that when the front and back covers are assembled the inner cavities of these support walls will be sealed. Support ribs are included to the inside base of the cover to add strength, as well as raise said buckle frame above the bottom of the cover and allow dust and debris to easily flow under the frame and exit the buckle system. The support ribs mentioned above run to the back of the cover essentially creating slots in the back of the buckle that allow dust and debris that gets channeled through the ribs to run directly to the back of the cover and out through the vents. They also support the back end of the buckle frame. In the top portion of the cover there are support ribs that protrude out from the inside surface. These are intended to support the cover by acting against the top portion of the buckle frame. The overall design intent is to surround the buckle frame with support from all directions to improve durability against impact and shock. Also, the intent is to protectively enclose all of the buckle components and continue to have open space to allow for good ventilation. The design intent is to let all dirt and debris that is able to get into the system, the ability to easily pass through and exit the system.

What is claimed is:

1. A buckle for a restraint system resistant to a harsh environment, the buckle comprising:

a frame having a base wall, the base wall includes a debris exit opening;

a cover which encloses the frame and forms at least one vent opening and at least one passage which couples the debris exit opening to the vent opening, whereby debris, dust and other foreign objects which find there way into the buckle are not necessarily trapped but rather are presented with a means of exiting the buckle via the vent opening and a tubular shaped bellow having an opening at opposite ends, a buckle connector extends within the bellow with a connector tongue extending out one end of the bellow and arranged to be compressed as the tongue is inserted into the buckle, the compressive force of the bellows forcing air into the buckle and out of the vent opening, thus blowing dirt and other debris out of the buckle and simultaneously seals off the buckle, and whereby compression of the bellow produces a spring force which assists in the ejection of the connector.

2. The buckle of claim 1, wherein the cover includes an inner face having ribs extending parallel along a length of the cover from the debris exit opening to the vent opening and forms the passage having channels formed between adjacent ribs.

3. The buckle of claim 2, wherein the ribs form a lower limit of a guide for a tongue upon being inserted into the buckle.

4. The buckle of claim 1, wherein the cover includes a bottom portion and a top portion, the cover, when assembled, defines a mouth at one end for receiving a tongue, and a vent opening at the other end, the bottom portion includes an inner face having a plurality of ribs extending parallel along a length of the cover to define channels extending from the opened mouth to the vent opening, the channels extending past, and opening to, the debris exit opening, whereby dust and debris and other foreign object may exit from within the buckle, into and through one of the channels and out of the buckle via the opened mouth or vent opening, particularly via the vent opening via gravity when the buckle is oriented with the mouth facing a direction generally upwards and the vent opening facing a direction generally downward.

5. The buckle of claim 1, wherein the frame includes a pair of flanges extending toward one another in a common plane, each flange having a notch, the flanges adapted for receiving a button release slide adapted to release a tongue from the frame, the button release slide having a groove on each side to be received by the respective flange, the groove formed in part by tabs extending outward and in engagement with the flanges, whereby sliding action of button release slide causes dirt and other debris to fall through the notch and avoid being lodged between the flange and the button release slide.

6. The buckle of claim 1, further comprising a support rib formed in the cover to define a cavity to receive and retain an electrical switch, whereby the switch is arranged so as to be activated upon a belt connector having been fully inserted into the buckle, so as to produce a signal to indicate a locked condition.

7. The buckle of claim 1, further comprising a plurality of support walls formed in the cover and extending from a bottom portion of the cover to a top portion of the cover, the support walls arranged to engage the frame and retain the frame in position with respect to the cover, whereby the support walls do not form ledges which attract and retain debris.

8. The buckle of claim 1, further comprising a button release slide slideably secured to the frame and adapted to release a connector from the frame, the button release slide having a button face at one end, the button face includes a front surface which is substantially flush with a front surface of the cover, and a top surface which is at approximately a right angle to the front surface and is substantially flush with a top surface of the cover, whereby a large surface area of the button face is exposed and readily actuated by a user even if the user is wearing heavy gloves.

9. The buckle of claim 1, wherein a hole is located in the base wall toward the rear of the frame and along the centerline of the base wall, the frame having side walls extending up from the base wall, and a pair of slots located in the side walls and in opposed facing relationship and on either side of the hole, the buckle further comprising a bracket extending across the frame with a first end extending through one of the side wall slots and a second end extending through the other side wall slot, the bracket further having a hole located in a central portion of the bracket, a button spring retainer extending up from the central portion and having an end extending forward toward the mouth of the buckle, and a pair of downwardly bent tabs opposite the hole in the bracket, the buckle further having a cable with a cable end fitting at the end, the fitting having a hole, the fitting secured between the frame base wall and the bracket with a fastener extending through the bracket, fitting and frame, with the downwardly bent tabs surrounding and trapping the fitting in position.

* * * * *